US008550899B2

(12) United States Patent
Hornik et al.

(10) Patent No.: US 8,550,899 B2
(45) **Date of Patent: *Oct. 8, 2013**

(54) WAGERING GAME WITH MULTIPLE REELS FORMING MULTIPLE SYMBOL ARRAYS

(75) Inventors: Jeremy M. Hornik, Chicago, IL (US); Allon G. Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/468,418

(22) Filed: May 10, 2012

(65) Prior Publication Data

US 2013/0005427 A1 Jan. 3, 2013

Related U.S. Application Data

(63) Continuation of application No. 12/438,985, filed as application No. PCT/US2007/019193 on Aug. 31, 2007, now Pat. No. 8,197,329.

(60) Provisional application No. 60/936,463, filed on Jun. 20, 2007, provisional application No. 60/842,059, filed on Sep. 1, 2006.

(51) Int. Cl.
*A63F 9/24* (2006.01)

(52) U.S. Cl.
USPC ..... 463/20; 273/143 R

(58) Field of Classification Search
USPC ..... 463/16–25; 273/143 R, 138.1
See application file for complete search history.

(56) References Cited

U.S. PATENT DOCUMENTS

| | | | |
|---|---|---|---|
| 4,184,683 | A | 1/1980 | Hooker |
| 4,198,052 | A | 4/1980 | Gauselmann |
| 5,580,053 | A | 12/1996 | Crouch |
| 5,611,535 | A | 3/1997 | Tiberio |
| 5,976,016 | A | 11/1999 | Moody et al. |
| 6,241,607 | B1 | 6/2001 | Payne et al. |
| 6,261,178 | B1 | 7/2001 | Bennett |
| 6,413,162 | B1 | 7/2002 | Baerlocher et al. |
| 6,544,120 | B2 | 4/2003 | Ainsworth |
| 6,604,999 | B2 | 8/2003 | Ainsworth |
| 6,676,511 | B2 | 1/2004 | Payne et al. |
| 7,001,274 | B2 | 2/2006 | Baerlocher et al. |
| 7,309,281 | B2 | 12/2007 | Baerlocher et al. |

(Continued)

FOREIGN PATENT DOCUMENTS

| | | |
|---|---|---|
| WO | WO 00/20082 | 1/2000 |
| WO | WO 02/18025 | 3/2002 |

OTHER PUBLICATIONS

International Search Report mailed Apr. 3, 2008 issued in corresponding International Patent Application No. PCT/US2007/019193 (2 pages).

(Continued)

*Primary Examiner* — Masud Ahmed
(74) *Attorney, Agent, or Firm* — Nixon Peabody LLP

(57) ABSTRACT

A gaming system for playing a wagering game comprises at least one display adapted to display a plurality of reels having symbols. The symbols indicate a randomly selected outcome of the wagering game. The plurality of reels includes at least one single-symbol reel and at least one multi-symbol reel. The at least one display is adapted to display at least one payline overlapping at least one symbol from the at least one single-symbol reel and at least one symbol from the at least one multi-symbol reel.

20 Claims, 15 Drawing Sheets

(56) References Cited

U.S. PATENT DOCUMENTS

| | | | |
|---|---|---|---|
| 7,309,282 | B2 | 12/2007 | Baerlocher et al. |
| 7,347,777 | B2 | 3/2008 | Gauselmann |
| 7,387,570 | B2 | 6/2008 | Randall |
| 7,393,277 | B2 | 7/2008 | Jackson |
| 7,431,645 | B2 | 10/2008 | Han et al. |
| 7,494,413 | B2 | 2/2009 | Singer et al. |
| 2004/0033827 | A1 | 2/2004 | Gilmore et al. |
| 2006/0111174 | A1 | 5/2006 | Baerlocher et al. |
| 2006/0160613 | A1 | 7/2006 | Hornik et al. |
| 2007/0060255 | A1 | 3/2007 | Baerlocher et al. |

OTHER PUBLICATIONS

Written Opinion mailed Apr. 3, 2008 issued in corresponding International Patent Application No. PCT/US2007/019193 (3 pages).

WAGERING GAME WITH MULTIPLE REELS FORMING MULTIPLE SYMBOL ARRAYS

CROSS REFERENCE TO RELATED APPLICATIONS

This application is a continuation of U.S. patent application Ser. No. 12/438,985, filed Feb. 26, 2009, which is a U.S. national stage of International Application No. PCT/US2007/019193, filed Aug. 31, 2007, which is related to and claims priority to U.S. Provisional Application No. 60/936,463, filed Jun. 20, 2007 and U.S. Provisional Application No. 60/842,059, filed Sep. 1, 2006, each of which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game with multiple reels forming a plurality of symbol arrays.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system for playing a wagering game comprises at least one display adapted to display a plurality of reels having symbols. The symbols indicate a randomly selected outcome of the wagering game. The plurality of reels includes at least one single-symbol reel and at least one multi-symbol reel. The at least one display is adapted to display at least one payline overlapping at least one symbol from the at least one single-symbol reel and at least one symbol from the at least one multi-symbol reel.

According to another aspect of the present invention, a method of conducting a wagering game on a gaming system comprises displaying a plurality of reels having symbols for indicating a randomly selected outcome of the wagering game. The plurality of reels includes at least one single-symbol reel and at least one multi-symbol reel. The method further comprises forming a payline extending through at least one single-symbol reel and at least one multi-symbol reel.

According to yet another aspect of the present invention, a method of conducting a wagering game on a gaming system comprises displaying an array of symbols that indicate a randomly selected outcome of the wagering game. The array includes at least one single-symbol-reel and at least one multi-symbol reel. The method further comprises displaying a plurality of player-selectable symbols in a symbol-pick field. The method further comprises selecting one of the plurality of player-selectable symbols from the symbol-pick field. The method further comprises displaying the selected player-selectable symbol on at least one single-symbol reel to form a new array. The method further comprises determining whether the new array includes a winning symbol combination on an active payline extending through at least one single-symbol reel and at lest one multi-symbol reel.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
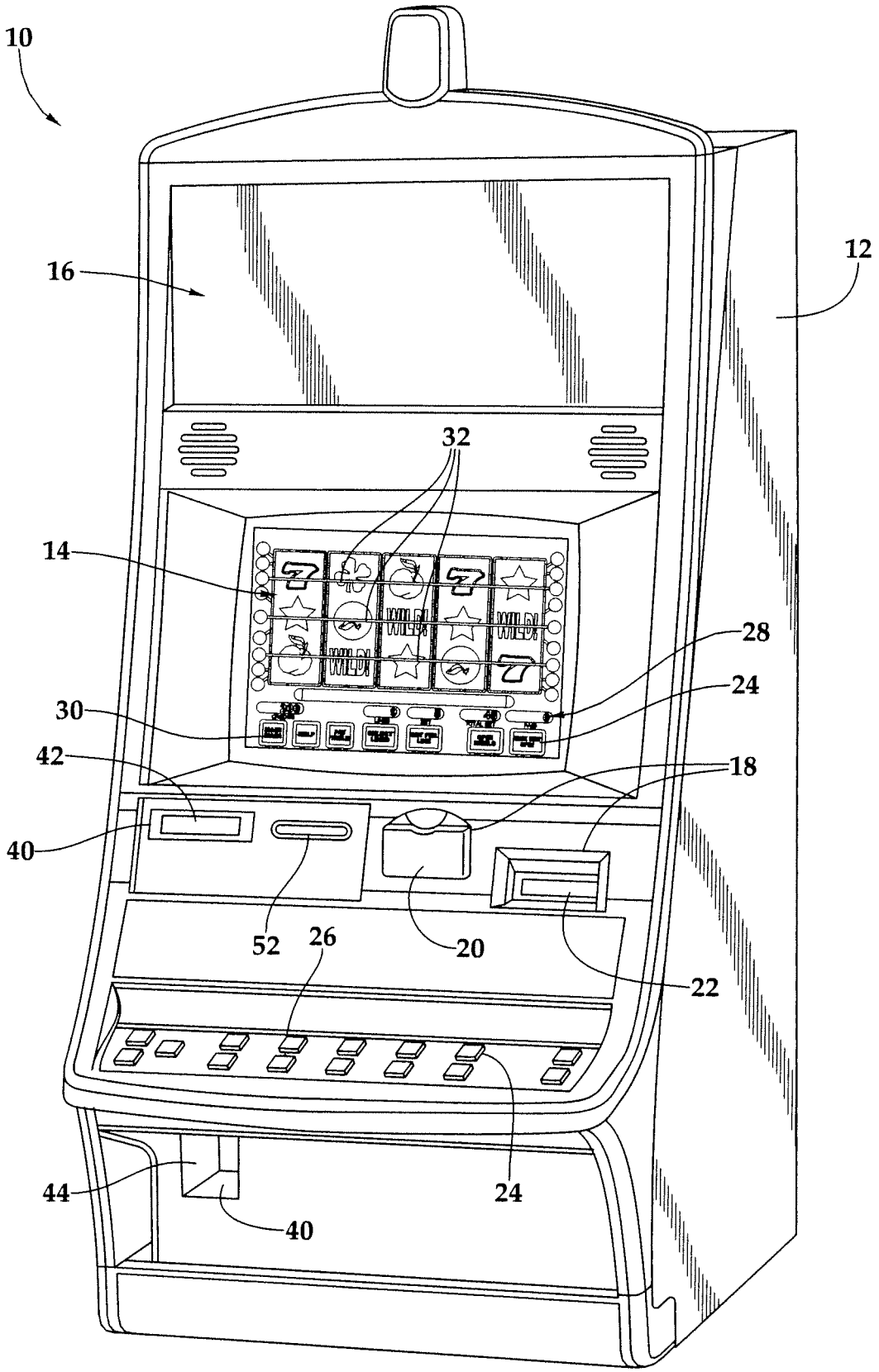
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
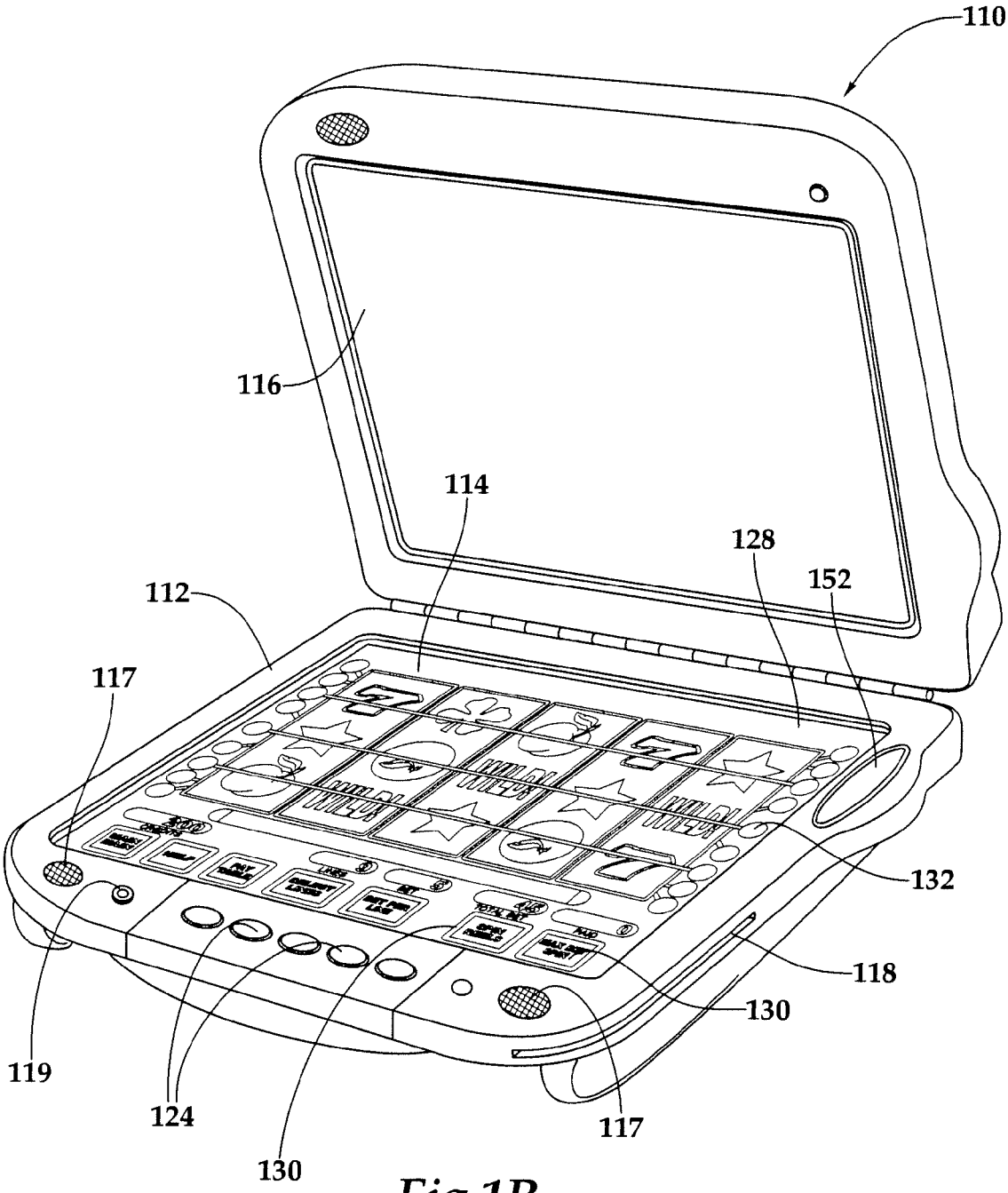
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
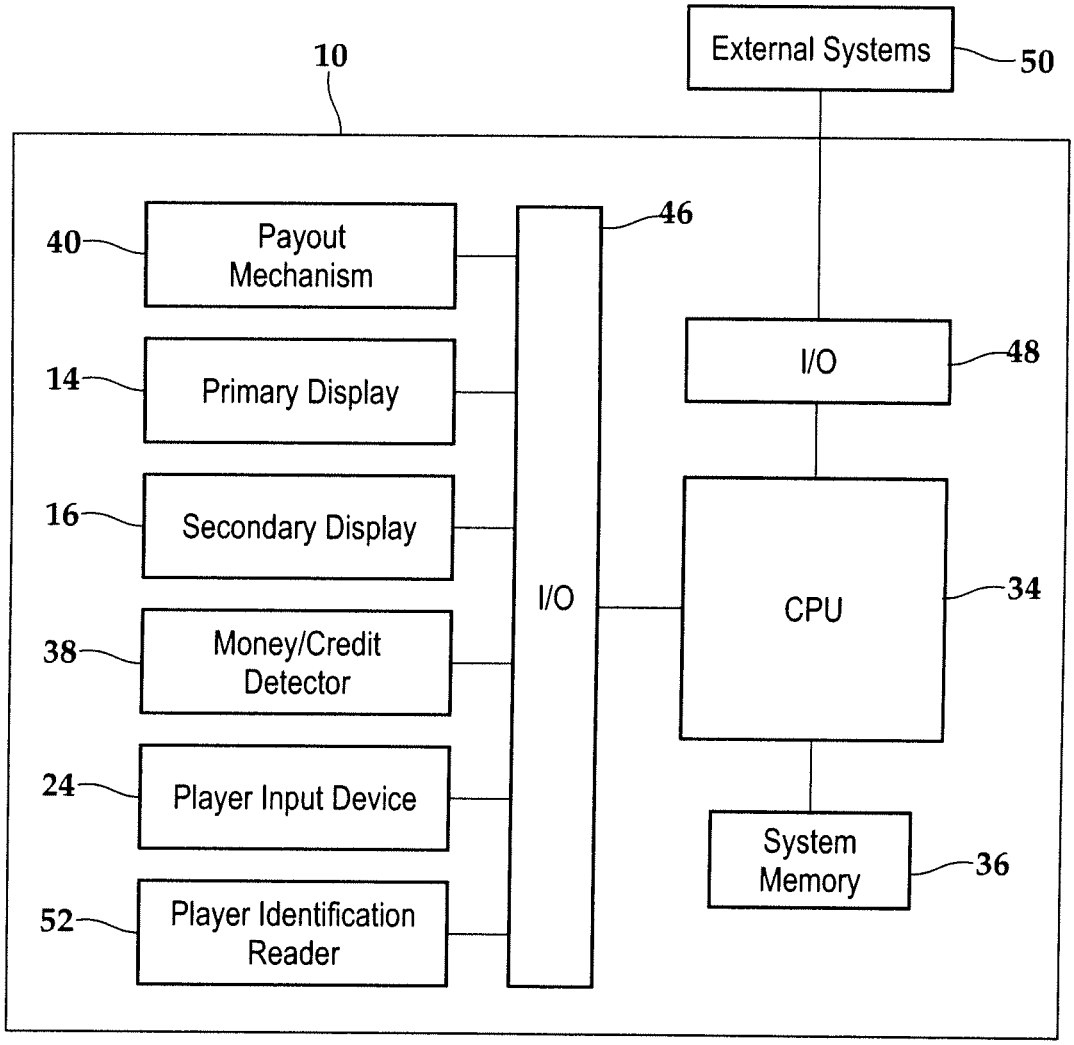
FIG. 2 is a block diagram of a control system suitable for operating the gaming machines of FIGS. 1*a* and 1*b*.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
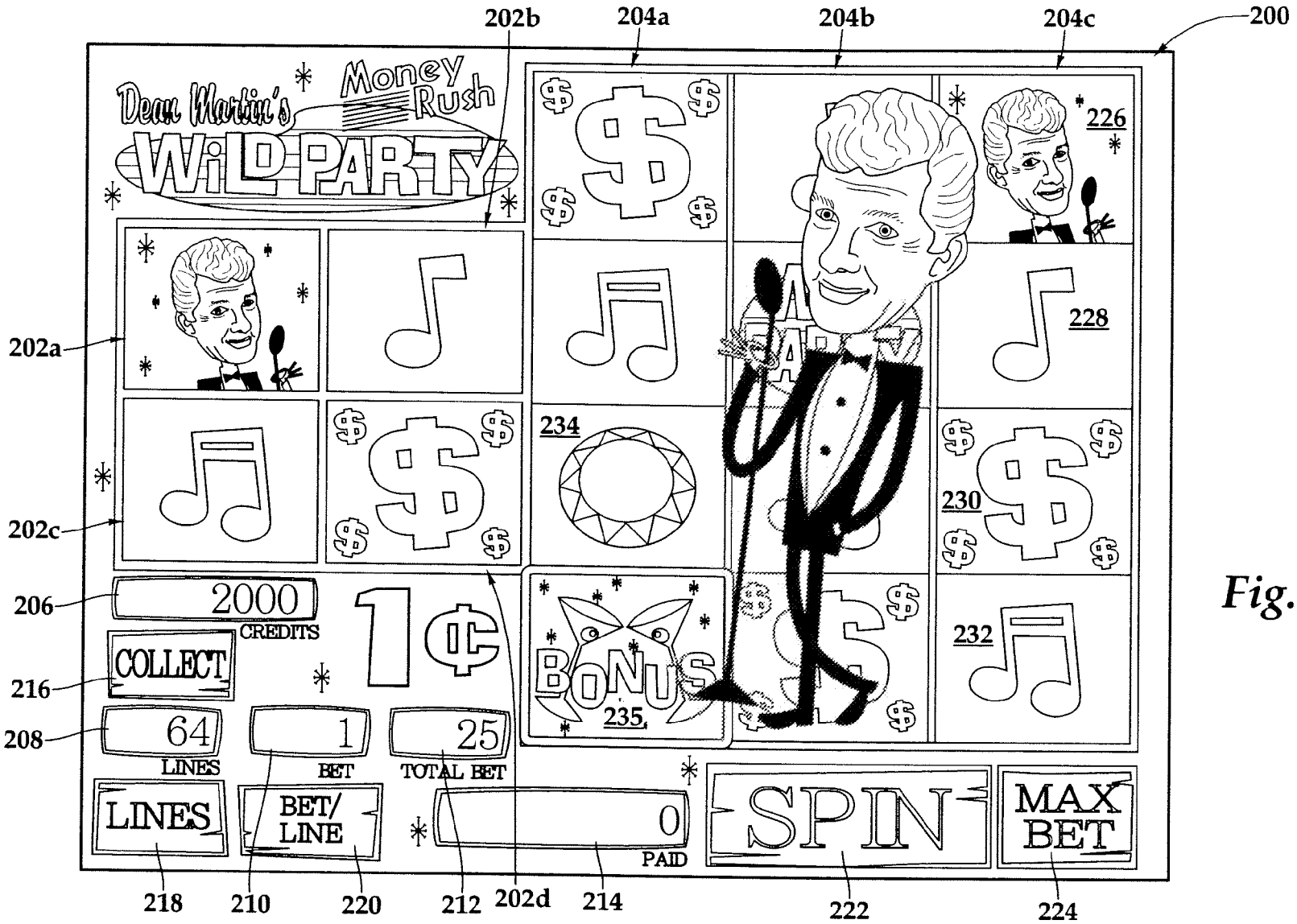
FIG. 3 is an illustration of a basic game screen incorporating the present invention.

Turning now to FIG. 3, an image of a main game screen 200 is illustrated, according to one embodiment of the present invention. A player begins play of a basic wagering game by inserting a wager into the value input device 18 of the gaming machine 10. A player can select play by using the player input device 24, via the buttons 26 or the touch screen keys 30, which are shown in FIGS. 1-2. The CPU 34 (or a controller in the wagering game control network in alternative embodiments) operates to execute a wagering game program causing the primary display 14 to display the wagering game that includes a plurality of visual elements.

The game screen 200 may be displayed on the primary display 14 or on a portion thereof. In the illustrated embodiment, the game screen 200 is used to display a plurality of simulated, movable reels 202*a-d* and 204*a-c* with symbols displayed thereon. As shown, the reels 202*a-d* display a single symbol, while the reels 204*a-c* display multiple symbols, as will be described in more detail below. The single-symbol reels 202*a-d* and the multi-symbol reels 204*a-c* are positioned such that the symbols are displayed relative to at least one payline (see, e.g., paylines 240*a-d* in FIG. 6), yielding a plurality of outcomes for the game. The basic game screen 200 may also display a plurality of game session meters and various buttons selectable by a player. The game session meters include a "credits" meter 206 for displaying a number of credits available for play on the machine; a "lines" meter 208 for displaying a number of paylines to be played by a player on the machine; a "bet" meter 210 for displaying a number of credits wagered (e.g., from 1 to 5 credits) for each of the number of paylines played; a "total bet" meter 212 for displaying a total number of credits wagered for the particular round of wagering; and a "paid" meter 214 for displaying an amount to be awarded based on the results of the particular rounds wager. The user-selectable buttons include a "collect" button 216 to collect the credits remaining in the credits meter 206; a "lines" button 218 for changing the number of paylines (displayed in the lines meter 208) a player wishes to play; a "bet/line" button 220 for changing the amount of the wager that is displayed in the bet meter 210; a "spin" button 222 for moving the single-symbol reels 202*a-d* (and potentially the multi-symbol reels 204*a-c*, as will be described below); and a "max bet" button 224 for wagering a maximum number of credits and moving the single-symbol reels 202*a-d* (and potentially the multi-symbol reels 204*a-c*) of the wagering game. While the gaming machine 10 allows for these types of player inputs, the present invention does not require them and can be used on gaming machines having more, less, or different player inputs.

In FIG. 3, four single-symbol reels 202*a-d* and three multi-symbol reels 204*a-c* are illustrated. However, there may be more or less single and multi symbol reels 202, 204 in accordance with the present invention. Furthermore, while each multi-symbol reel 204*a-c* displays four symbols, it is contemplated that more or less symbols may be displayed on these reels. Additionally, though each of the single-symbol reels 202*a-d* displays only a single symbol while at rest, it should be noted that each of the single-symbol reels 202*a-d* include a plurality of symbols capable of being displayed thereon.

Figure 6:
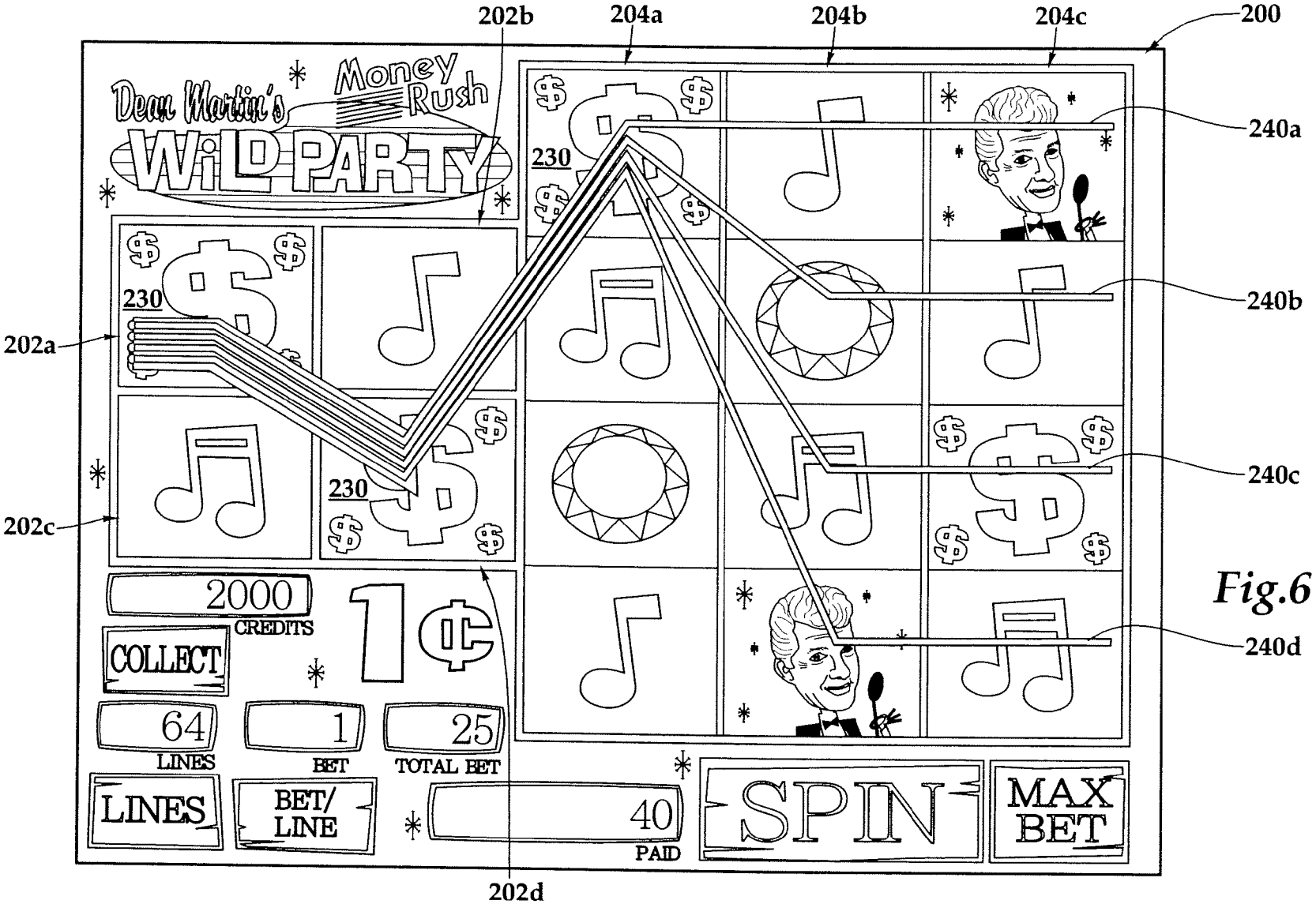
FIG. 6 is an illustration of the play of the basic game incorporating the present invention after the multi-symbol reels have stopped spinning.

The plurality of symbols displayed on the single-symbol reels 202*a-d* and the multi-symbol reels 204*a-c* are used to indicate a plurality of possible outcomes along the activated paylines (e.g., 240*a-d* in FIG. 6). The depicted symbols all correspond to a "DEAN MARTIN'S WILD PARTY" theme and include: "DEAN MARTIN" symbols 226; "SINGLE MUSICAL NOTE" symbols 228; "MONEY" symbols 230; "DOUBLE MUSICAL NOTE" symbols 232; "JEWEL" symbols 234; and "BONUS" symbols 235. Other DEAN MARTIN'S WILD PARTY-themed symbols may also be depicted. In other embodiments of the present invention, the gaming machine 10, 110 may portray other themes with corresponding like-themed symbols. Further, standard gaming symbols such as "1-BAR" symbols, "2-BAR" symbols, "3-BAR" symbols, "CHERRY" symbols, "SEVEN" symbols, and "BELL" symbols may be depicted on the reels in other embodiments. The single-symbol reels 202*a-d* and the multi-symbol reels 204*a-c* displaying these symbols may be either traditional mechanical reels or they may be computer-generated images of reels.

A winning combination occurs when the symbols appearing on the single-symbol reels 202*a-d* and the multi-symbol reels 204*a-c* along an active payline (see e.g., 240*a-d* in FIG. 6) correspond to one of the winning symbol combinations listed in a pay table, which is typically stored in the system memory 36 of the gaming machine 10, 110. The pay table may also be displayed on the secondary display 16, the primary display 14, or both and be either displayed constantly, intermittently, or upon request by a player. Winning combinations listed in the pay table can include three like-symbols appearing on a payline yielding a first payout, four like-symbols appearing on a payline yielding a second, larger payout, and five like-symbols appearing on a payline yielding a third, even larger payout.

The number of paylines activated may correspond to the size of the wager placed. For example, large wagers activate more paylines than smaller wagers. The maximum wager may activate the maximum amount of paylines. In some embodiments, the player may be awarded a certain number of free spins by placing the maximum wager.

Figure 4:
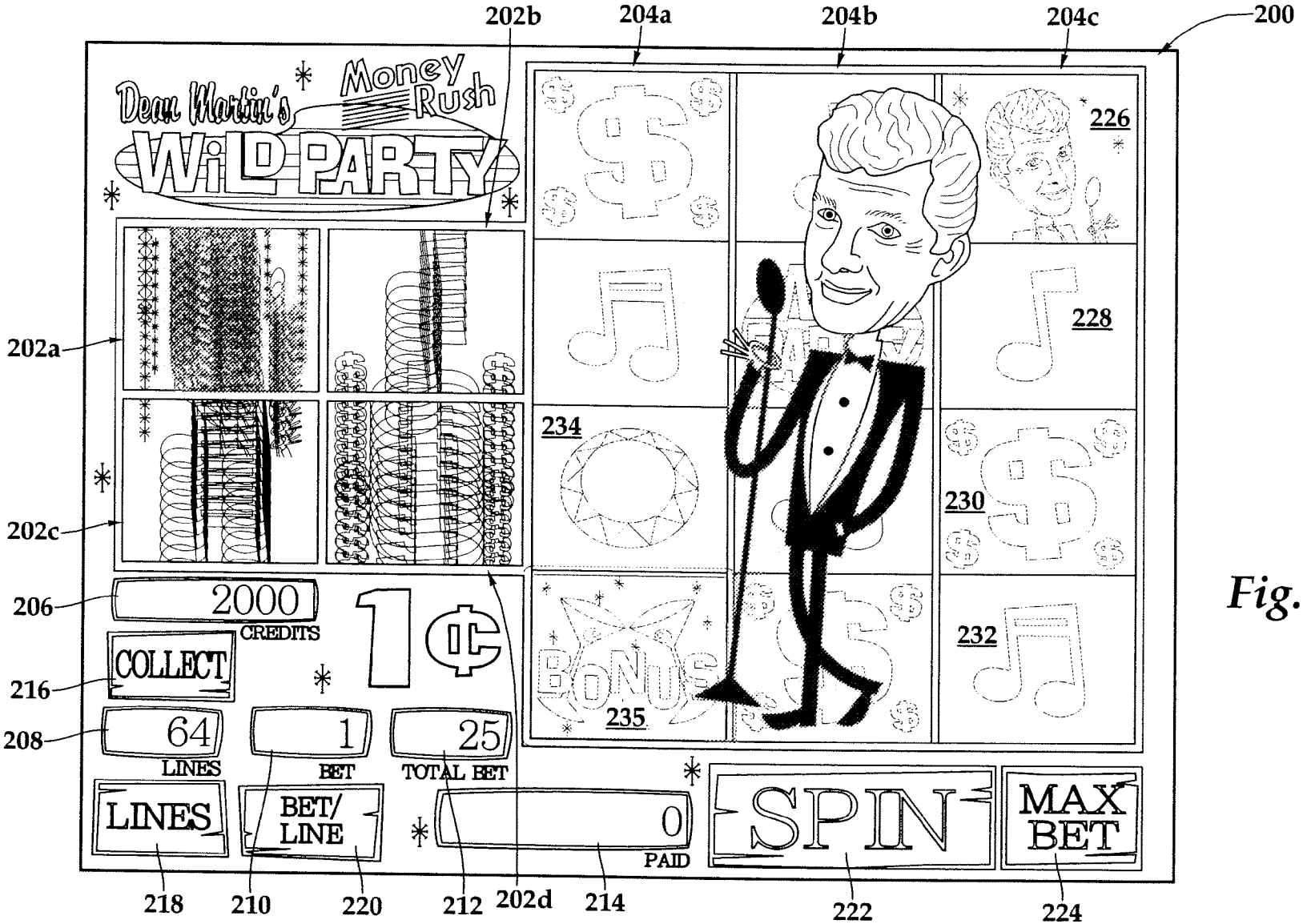
FIG. 4 is an illustration of a play of the basic game incorporating the present invention after a plurality of single-symbol reels have begun to spin.

Once the player has selected the lines and placed the wager, the player can select the spin button 222. Referring now to FIG. 4, once the player has selected the spin button 222, the single-symbol reels 202*a-d* begin to spin. In one preferred embodiment, the multi-symbol reels 204*a-c* only spin and/or stop if a certain condition is met by the single-symbol reels 202*a-d*. In one aspect, the certain condition is met when one of the single symbols reels 202*a* and 202*c* displays the same symbol as one of the single symbol reels 202*b* and 202*d* along an active payline. In other words, the certain condition is met when at least a partial winning combination is formed by the single-symbol reels 202*a-d*. Accordingly, if the certain condition is not met, the game progresses rather quickly because the multi-symbol reels 204*a-c* do not spin and less time is consumed by each spin when compared to conventional gaming machines. As such, the gaming machine 10 incorporating the present invention enables more games to be played in a certain amount of time than conventional gaming machines where the player is typically required to wait for all the reels to spin and stop before another play.

In another embodiment, the multi-symbol reels 204*a-c* spin and stop regardless of whether or not a certain predetermined condition is met, e.g., when at least a partial winning combination is formed on the single-symbol reels 202*a-d*. In this embodiment, the multi-symbol reels 204*a-c* may spin prior to, simultaneously with, or after the single-symbol reels 202*a-d* spin.

Figure 5:
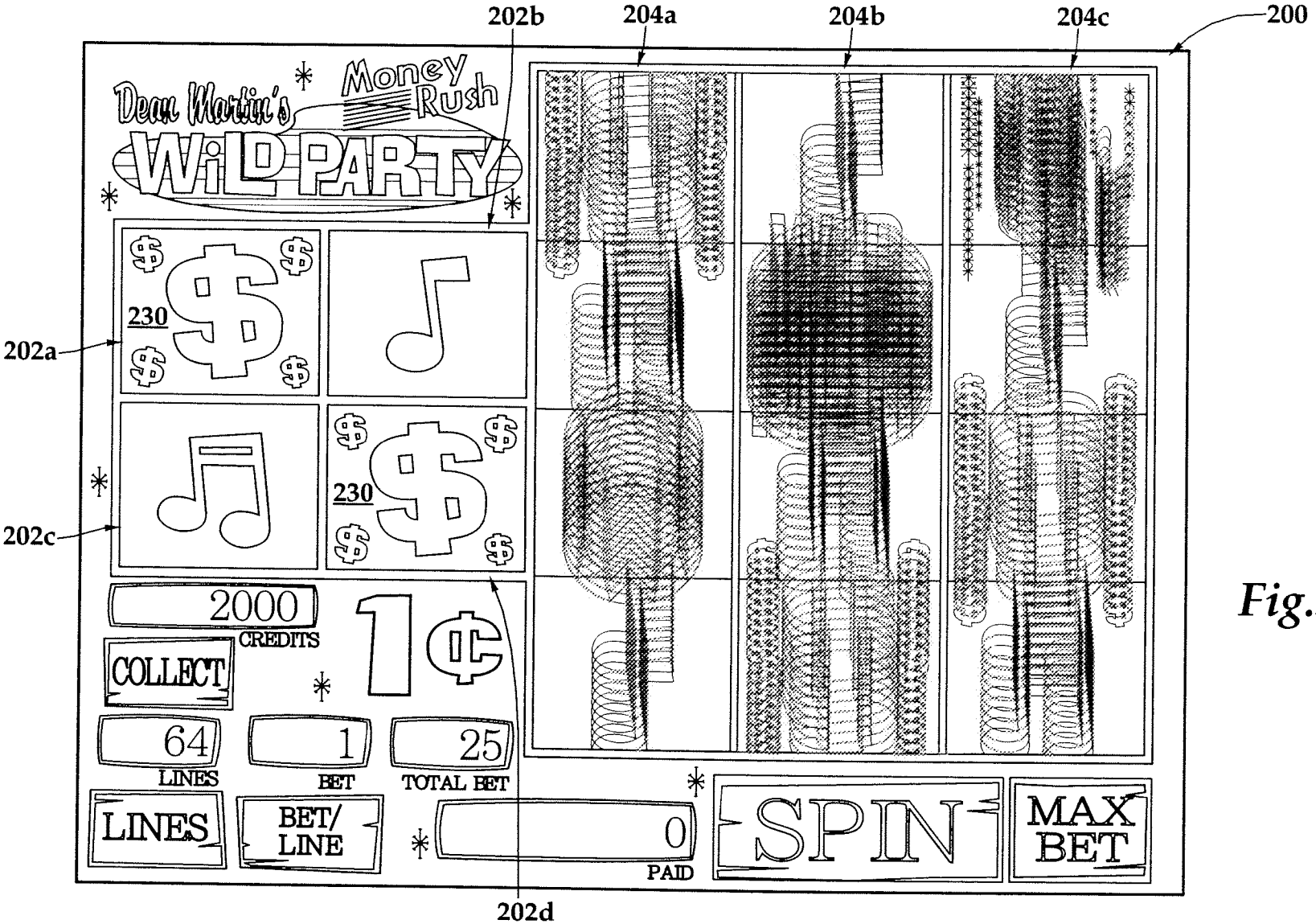
FIG. 5 is an illustration of the play of the basic game incorporating the present invention after the single-symbol symbols have stopped spinning and the multi-symbol reels have begun to spin.

Referring now to FIG. 5, the single-symbol reels 202*a* and 202*d* have landed on MONEY symbols 230. Because the pre-determined condition is met in this embodiment (i.e., a partial winning combination is formed), the multi-symbol reels 204*a-c* are "unlocked" and begin to spin. Generally, no additional player interaction is required to spin the multi-symbol reels 204*a-c*. The multi-symbol reels will spin automatically when the pre-determined condition on the single-symbol reels 202*a-d* is met. However, in some embodiments, the game screen 200 may prompt for additional user action to spin the reels 204*a-c*, and possibly highlight the potential winning symbols in the single-symbol reels 202. In an alternate embodiment, the multi-symbol reels 204*a-c* are always spinning, but are only activated to stop and display reel symbols if the predetermined condition on the single-symbol reels 202*a-d* is met.

FIG. 6 illustrates the game screen 200 after all the reels 202*a-d* and 204*a-c* have stopped spinning. This particular spin resulted in four winning paylines 240*a-d* because at least three consecutive MONEY symbols 230 are displayed across the single-symbol reels 202*a-d* and the multi-symbol reels 204*a-c*. In accordance with the present invention, even a 3-symbol pay will overlap itself 4 times, as shown in FIG. 6.

It should be noted that aside from the MONEY symbols 230 located on reels 202*a*, 202*d*, and 204*a*, there is a MONEY symbol 230 located on the reel 204*c*. However, the MONEY symbol 230 on reel 204*c* does not assist in forming any winning paylines because paylines in the illustrated embodiment are formed only through consecutive symbols (e.g., MONEY symbols 230 on reels 202*a*, 202*d*, and 204*a*).

However, in other embodiments, paylines may be formed through non-consecutive symbols. Still referring to FIG. 6, in this type of embodiment, payline 240*c* would be a 4-symbol pay as opposed to the current 3-symbol pay. As such, the present invention contemplates the use of paylines through both consecutive and non-consecutive matching symbols. It should also be noted that the present invention contemplates embodiments where paylines are not used at all. In this type of embodiment, symbol combinations are made by matching symbols on adjacent reels.

Figure 7:
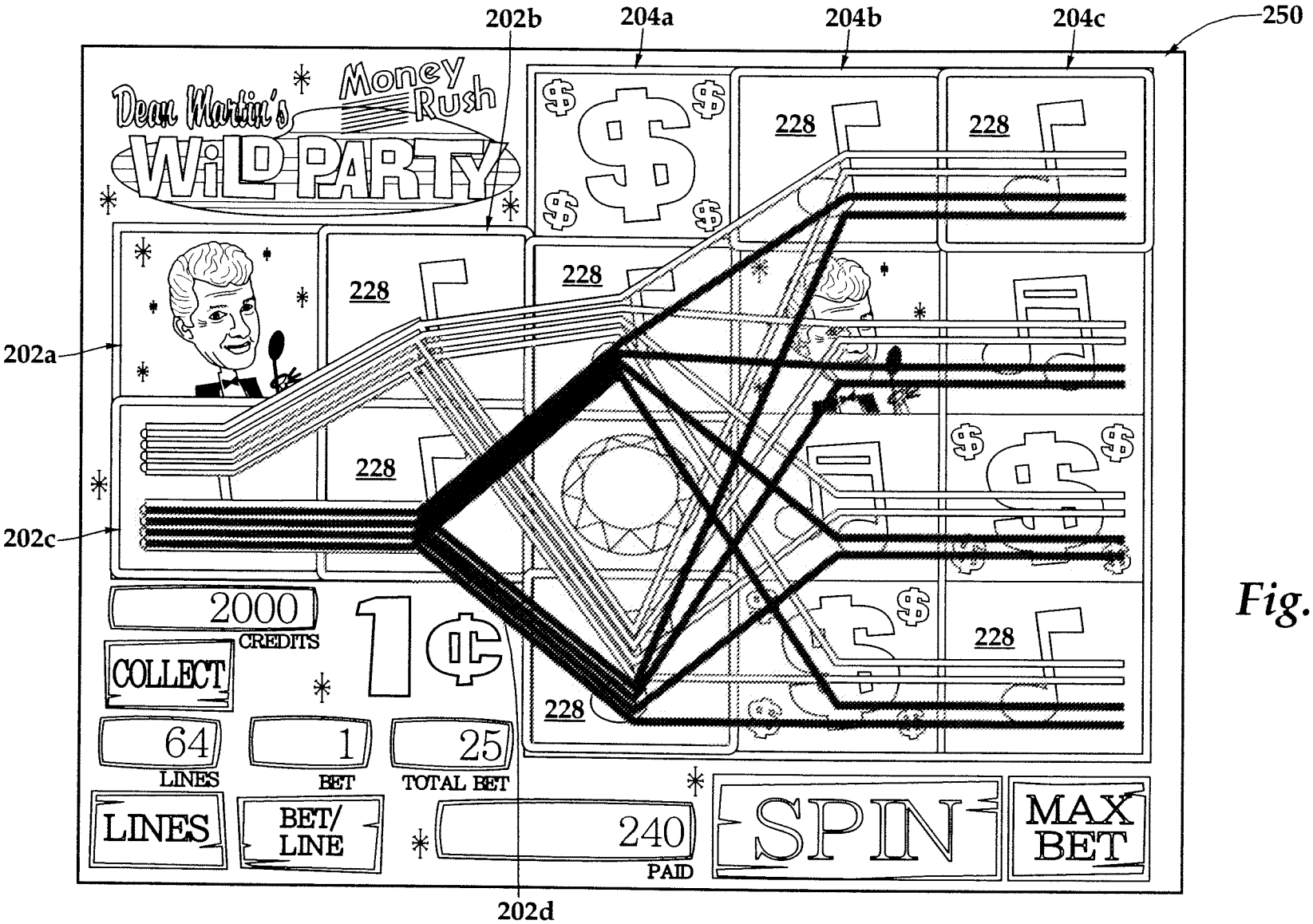
FIG. 7 is an illustration of another play of the basic game incorporating the present invention after all the reels have been spun.

Because each of the single-symbol reels 202*a-d* is an individual reel, it is possible to generate several overlapping and duplicated outcomes. Referring now to FIG. 7, a game screen 250 is shown after a separate spin of the reels. Here, three matching SINGLE MUSICAL NOTE symbols 228 have landed on the single-symbol reels 202*b*, 202*c*, and 202*d*. Accordingly, the multi-symbol reels 204*a-c* were "unlocked" and spun as a result of the at least 2-matching symbol condition on the single-symbol reels 202*a-d*. Here, the player has a 3 symbol-pay twelve times and a 5 symbol-pay four times. As mentioned above, non-consecutive symbol paylines may also be incorporated in some embodiments and would thus result in additional pays, if implemented here.

Figure 8:
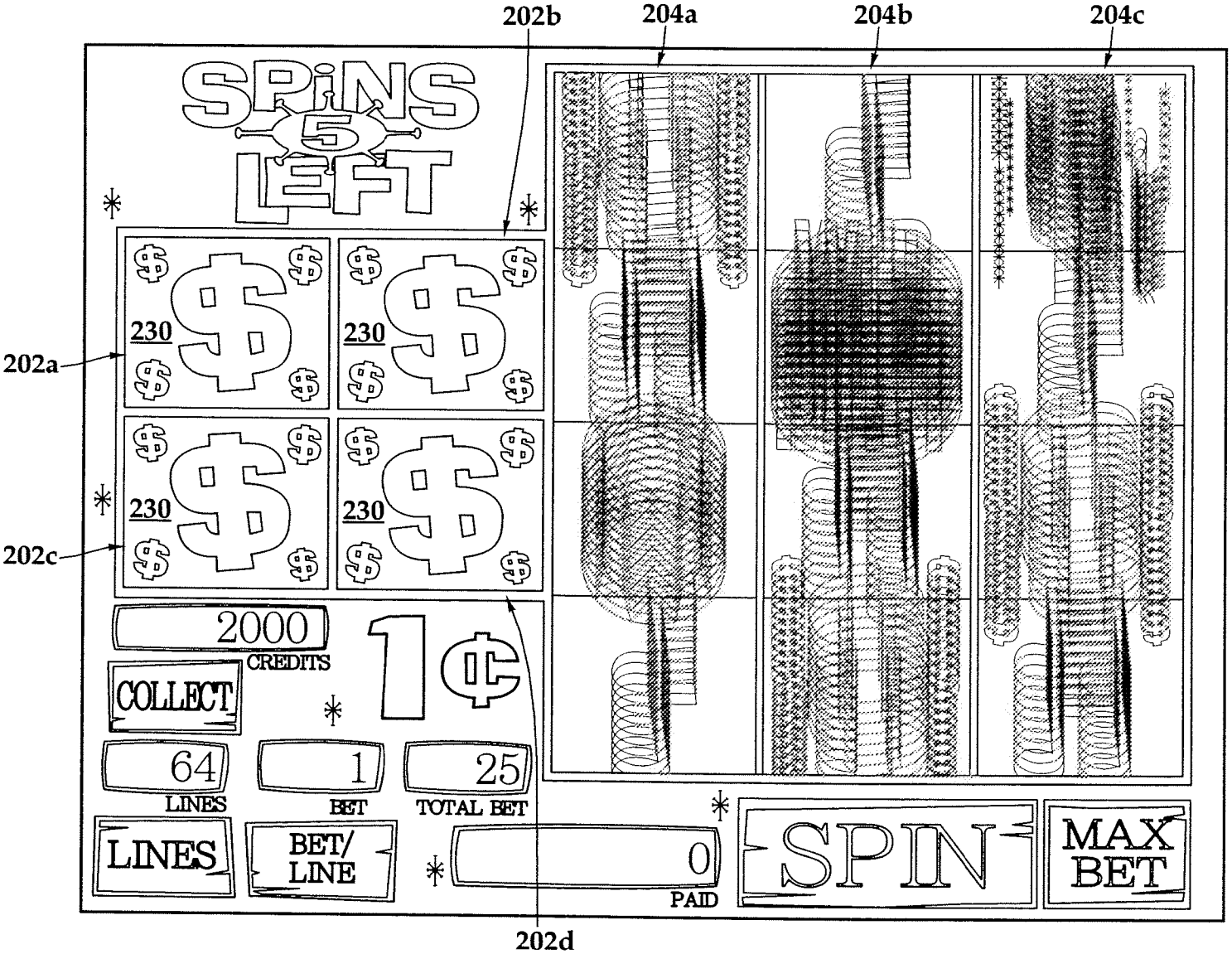
FIG. 8 is an illustration of another play of the basic game after the single-symbol reels have stopped spinning and the multi-symbol reels have begun to spin.

The present invention also contemplates the use of various additional features that may enhance the gaming experience. For example, referring now to FIG. 8, the single-symbol reels 202*a-d* have been spun and have all landed on the MONEY symbol 230. In one aspect, four matching symbols on the single-symbol reels 202*a-d* awards a bonus, in this case five free spins. Other ways of triggering bonuses are also contemplated. For example, the appearance of the bonus symbol 235 (FIG. 3) on one or more of the multi-symbol reels 204*a-c* after they have been spun may also award a certain number of free spins (i.e., a scatter trigger). In another example, four matching symbols on the single-symbol reels 202*a-d* and three matching symbols anywhere on the multi-symbol reels (i.e., scattered symbols) award a bonus of twenty free spins in which the single-symbol reels 202*a-d* are held (i.e., not spun). The appearance of a certain number of bonus symbols 235 may also trigger other types of bonus events, including, but not limited to additional credits, certain bonus games, other free spin events, top box bonuses, trail game bonuses, and all other kinds of bonus games. In this way, the four single-symbol reels 202*a-d* provide opportunities for displaying symbol combinations not necessarily possible on the multi-symbol reels 204*a-c*. In another embodiment, a "mystery bonus" may be awarded where the bonus is triggered randomly or for reasons unknown to the player.

Figure 9A:
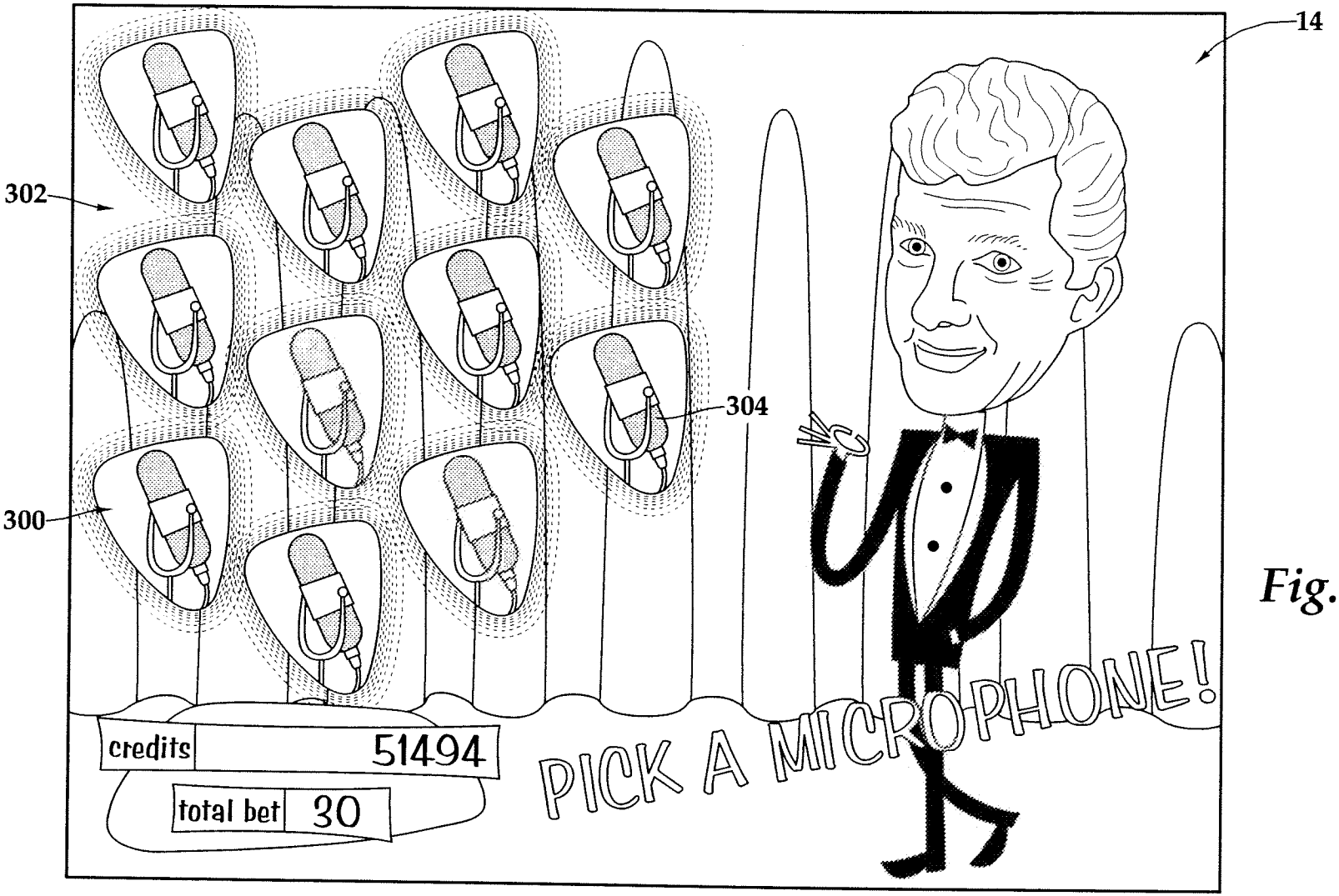
FIG. 9*a* is an illustration of a bonus game screen incorporating the present invention, according to one embodiment.
Figure 9B:
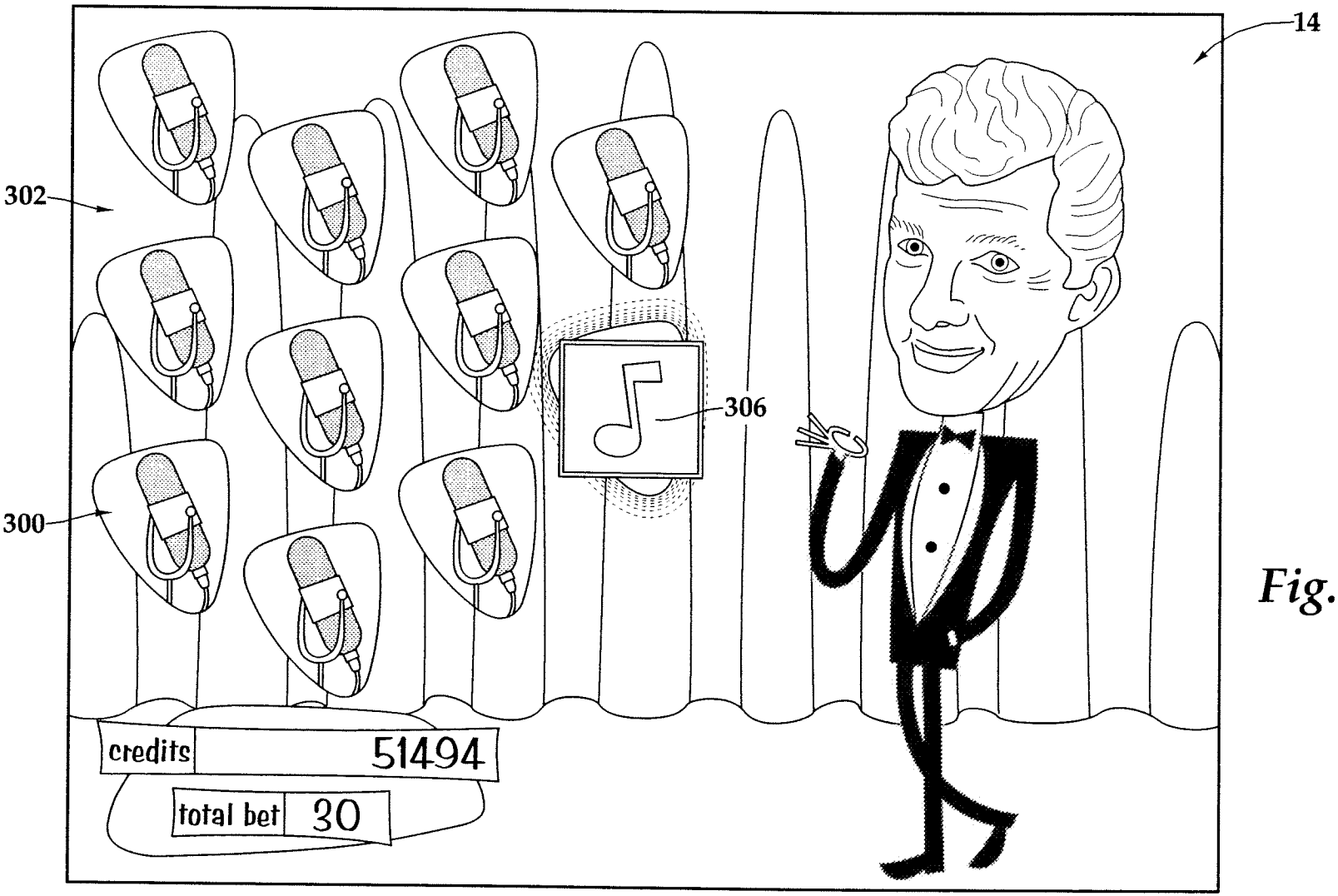
FIG. 9*b* is an illustration of a bonus game screen subsequent to the bonus game screen of FIG. 9*a*.

Other features that may enhance the gaming experience may also be implemented. In the bonus game of FIGS. 9*a-c*, for example, one or more of the single-symbol reels 202*a-d* may be held (e.g., not spun) during the bonus game(s). Referring to FIG. 9*a*, after the bonus game is triggered by, for example, any of the triggering outcomes described above, a plurality of MICROPHONE symbols 300 are displayed in a symbol pick field 302 on the display 14. The player is asked to select one of the MICROPHONE symbols 300 to reveal a hidden symbol. In the illustrated embodiment, the player selected a MICROPHONE symbol 304, which is uncovered to reveal a hidden SINGLE MUSICAL NOTE symbol 306, as illustrated in FIG. 9*b*. The symbols corresponding with the remaining MICROPHONE symbols 300 may also be revealed to the player, as shown in FIG. 9*c*.

Figure 9C:
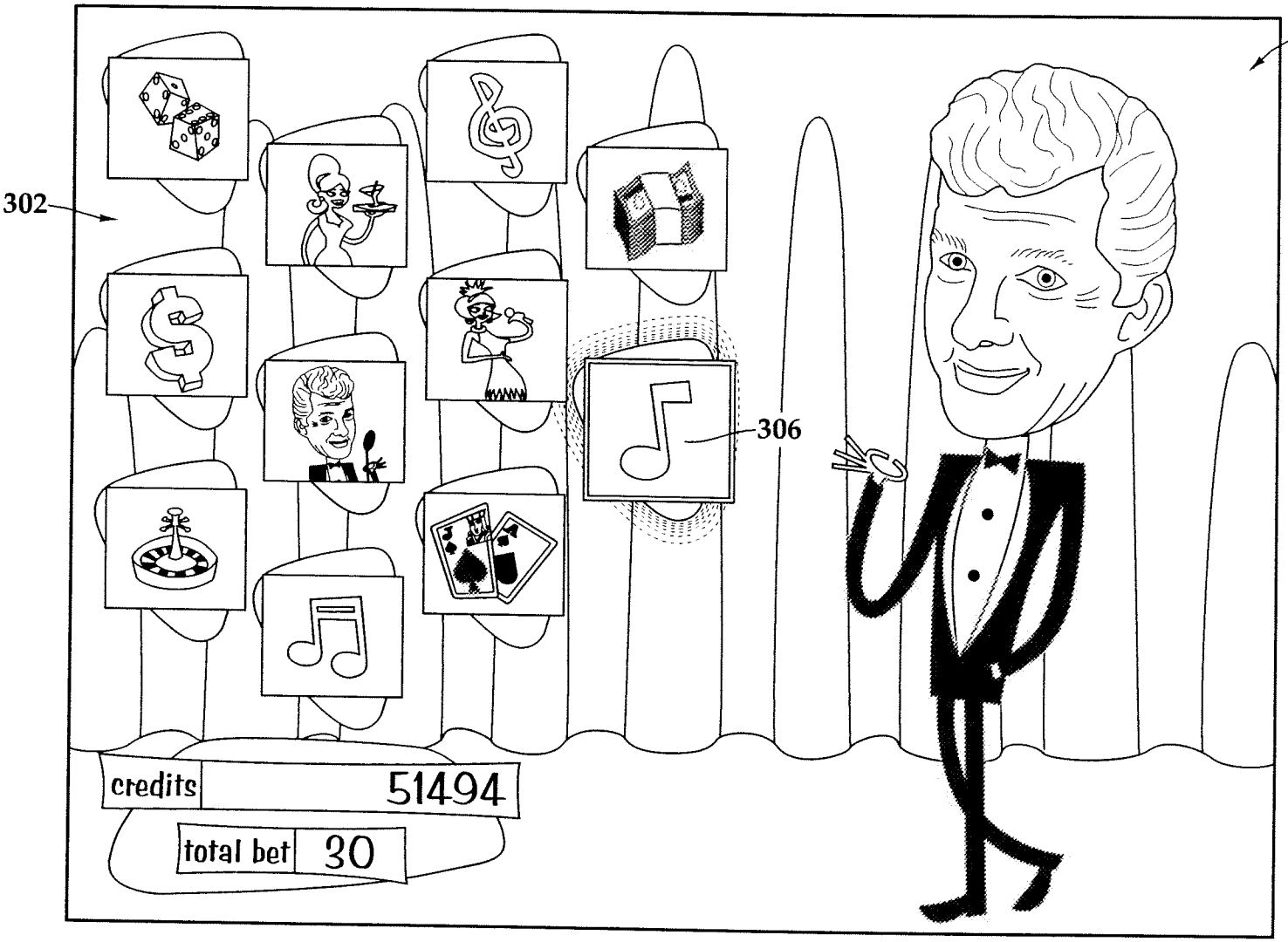
FIG. 9*c* is an illustration of a bonus game screen subsequent to the bonus game screen of FIG. 9*b*.
Figure 10:
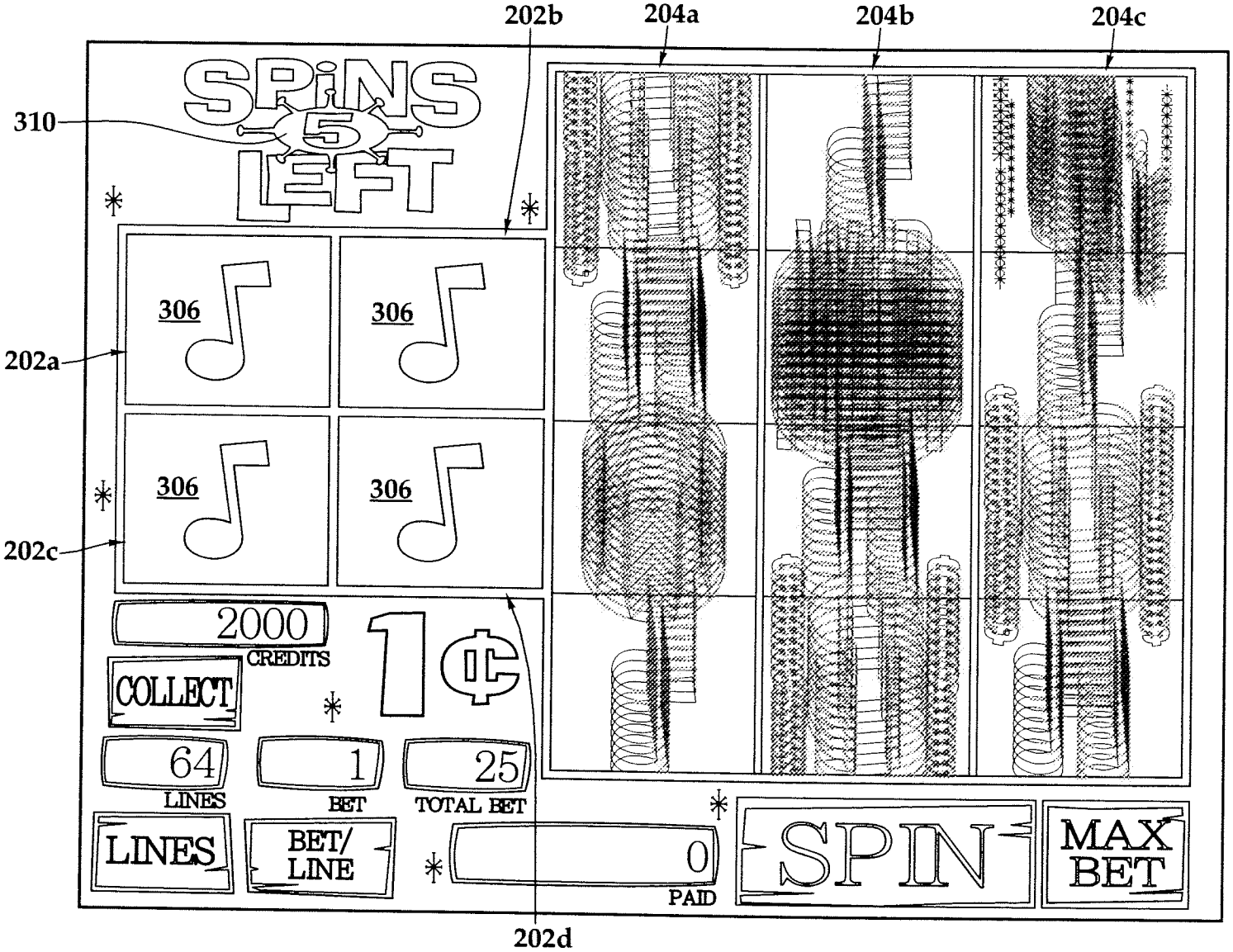
FIG. 10 is an illustration of a bonus game screen subsequent to the bonus game screen of FIG. 9*c*.

The SINGLE MUSICAL NOTE symbol 306 selected from the symbol pick field 302 of FIGS. 9*a-c* may be displayed on one or more of the single-symbol reels 202*a-d* during the bonus game. In the embodiment of FIG. 10, for example, SINGLE MUSICAL NOTE symbols 306 are displayed and held (e.g., not spun) in all four of the single-symbol reels 202*a-d*. Additionally, a SPINS LEFT indicator 310 indicates that the player has 5 spins remaining. The multi-symbol reels 204*a-c* are then spun, and the paylines are reevaluated to determine whether an award should be awarded to the player during the free spin(s).

The number of free spins may be preset, randomly determined, determined by a second pick field, or the like. In one embodiment, the player may select a symbol from a spin pick field that is uncovered to reveal a number corresponding with a number of free spins the player will receive. The spin pick field may look and operate similarly to the symbol pick field 302 of FIGS. 9*a-c*. The spin pick field may be displayed before or after the player selects a symbol from the symbol pick field of FIGS. 9*a-c*. The spin pick field may also be used to determine the quantity of free spins in bonus games as an alternative to the above-described method.

In another embodiment, the player may select a symbol from another pick field or the original pick field 302 of FIG. 9*a*. The selected symbol may then be uncovered to reveal a hidden symbol, as in FIG. 9*b*. If the award associated with the revealed symbol is greater than the award associated with the SINGLE MUSICAL NOTE symbols 306 of FIG. 10, the revealed symbol may replace the SINGLE MUSICAL NOTE symbols 306 on the single-symbol reels 202*a-d* during the remaining free spin(s).

Still additional features may be added to enhance the gaming experience. Some embodiments of the game incorporating the present invention may include symbols designated as "MULTIPLYING WILDS" and "EXPANDING WILDS" (not illustrated). The appearance of a "MULTIPLYING WILD" symbol, whether in the single-symbol reels 202*a-d* or the multi-symbol reels 204*a-c*, may multiply the amount of credits won (if a winning combination is formed) by an integer or non-integer number. The appearance of an "EXPANDING WILD" symbol in the multi-symbol reels 204*a-c* may expand to make the symbols on the entire reel wild.

Figure 11A:
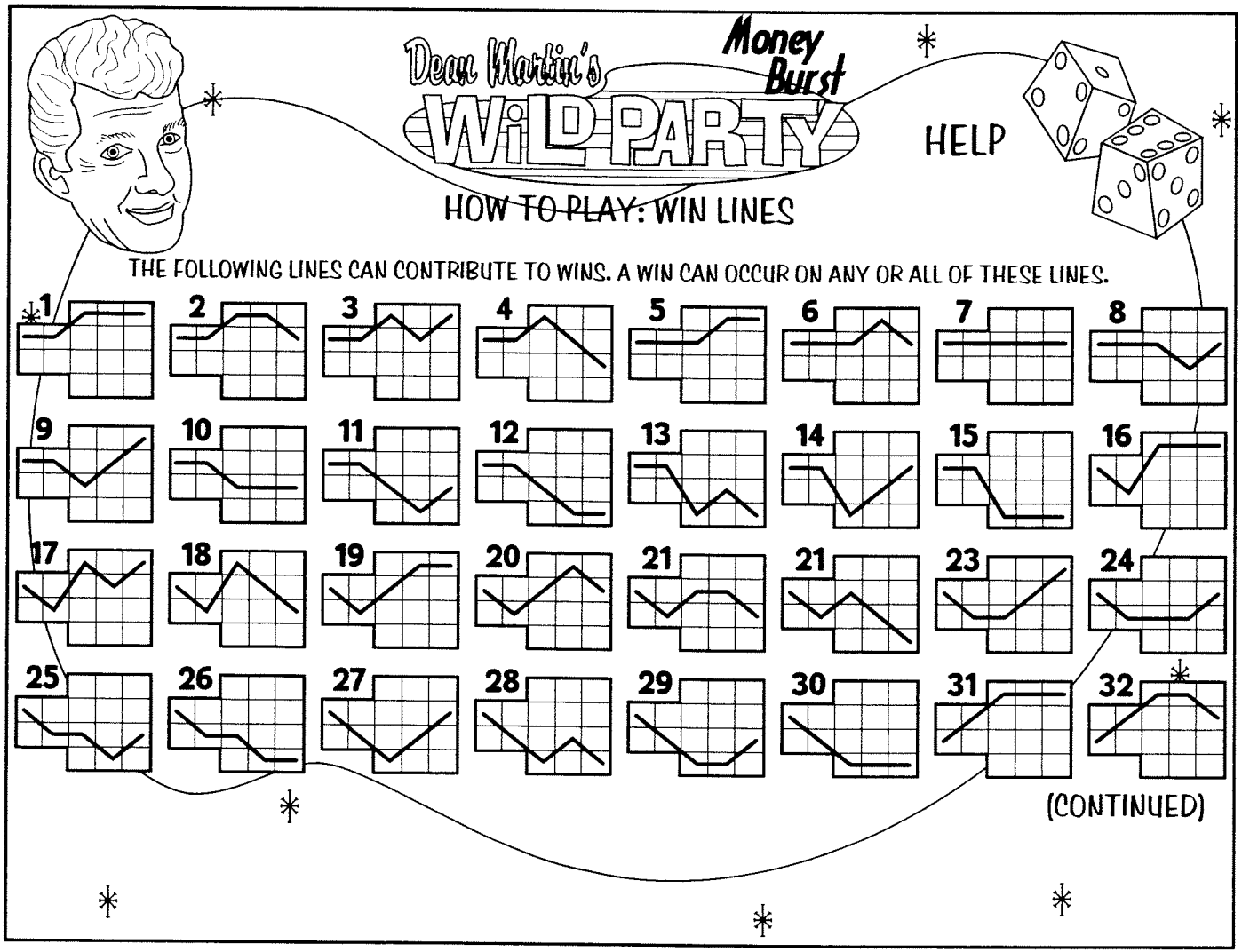
FIGS. 11*a-b* illustrate possible paylines according to one embodiment.
Figure 11B:
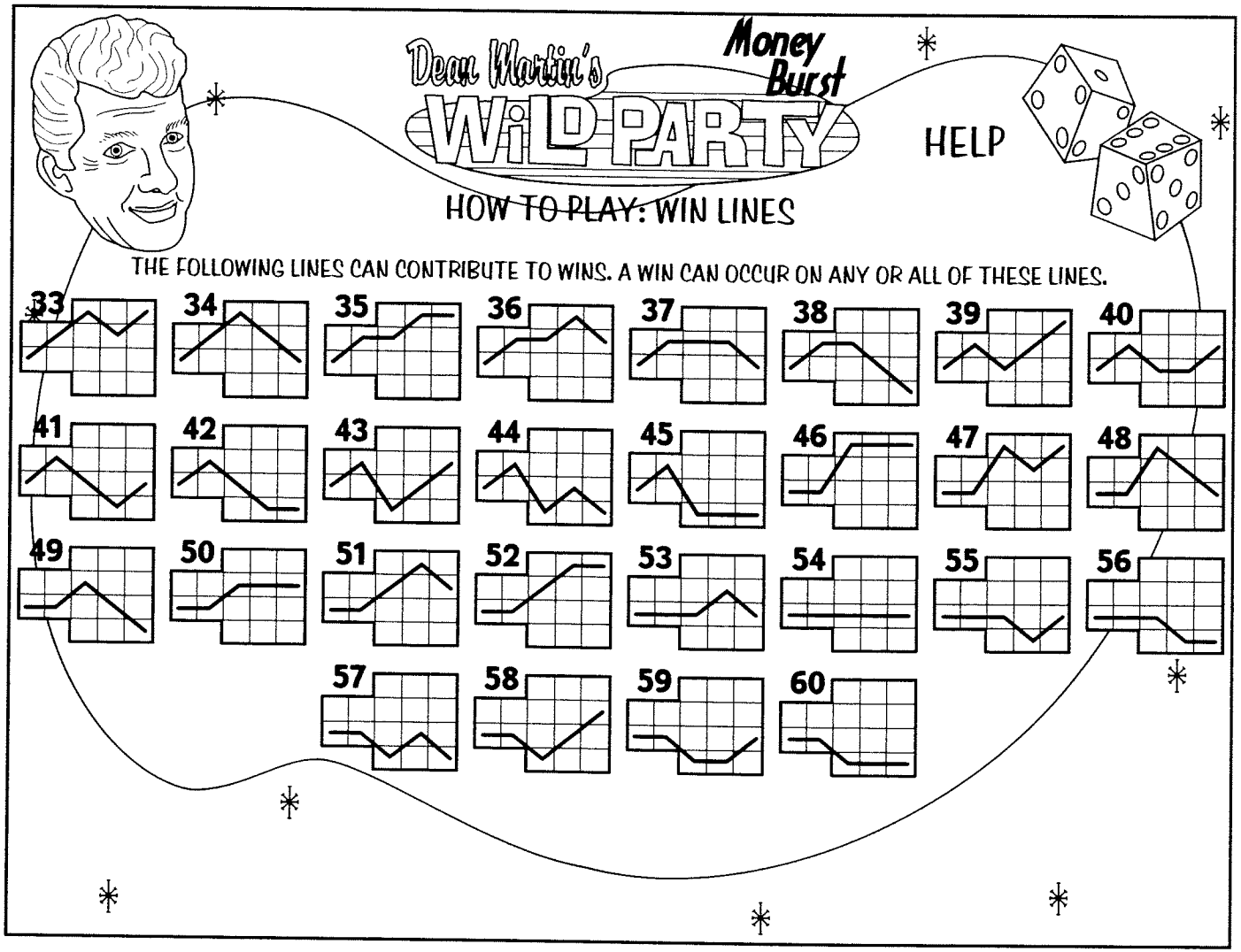

FIGS. 11*a-b* show sixty possible paylines that may be activated according to one embodiment. Because of the irregular shape of the arrays shown in FIGS. 11*a-b*, the paylines differ in arrangement from standard paylines. In one embodiment, a single credit may activate two paylines. As such, all sixty paylines of FIGS. 11*a-b* may be activated for thirty credits.

Each of these embodiments and obvious variations thereof is contemplated as falling within the spirit and scope of the claimed invention, which is set forth in the following claims. For example, the ways of forming winning combinations should not be limited to those disclosed thus far. A winning combination may also occur as a scatter win. A scatter win occurs when one or more pre-determined number of designated scatter symbols appear on the game screen of the gaming machine 10, without regard to paylines.

What is claimed is:

1. A gaming system comprising:

at least one input device;

at least one display device;

at least one processor; and at least one memory device storing instructions that, when executed by the at least one processor, cause the gaming system to receive a wager in response to an input via the at least one input device, display a plurality of reels on the at least one display device, the plurality of reels including at least one single-symbol reel for displaying a single symbol in a single symbol position and at least one multi-symbol reel for displaying a plurality of symbols in a respective plurality of symbol positions, and form a payline extending through the single symbol displayed on the at least one single-symbol reel and at least one of the plurality of symbols displayed on the at least one multi-symbol reel.

2. The gaming system of claim 1, wherein the plurality of reels includes a plurality of single-symbol reels.

3. The gaming system of claim 2, wherein the plurality of single-symbol reels form multiple columns, the randomly selected outcome being indicated by the symbols aligned along an active payline extending through at least two single symbols displayed on the respective single-symbol reels and at least one of the plurality of symbols displayed on at least one of the multi-symbol reels.

4. The gaming system of claim 2, wherein the plurality of single-symbol reels form a first group of rows, at least one payline extending through a first one of the first group of rows and at least one of the plurality of symbols displayed on at least one of the multi-symbol reels, at least another payline extending through a second one of the first group of rows and at least one of the plurality of symbols displayed on at least one of the multi-symbol reels, the randomly selected outcome being indicated by symbols aligned along the paylines.

5. The gaming system of claim 4, wherein the plurality of reels includes a plurality of multi-symbol reels forming a second group of rows, the number of rows in the first group of rows being less than the number of rows in the second group of rows.

6. The gaming system of claim 2, wherein the plurality of single-symbol reels is four, forming two rows and two columns.

7. The gaming system of claim 1, wherein each of the at least one single-symbol reel includes a second plurality of symbols, the single symbol displayed on the at least one single-symbol reel being one of the second plurality of symbols.

8. A method of conducting a wagering game on a gaming system, the method comprising:

in response to an input via at least one input device, receiving a wager, displaying a plurality of reels on at least one display device, the plurality of reels including at least one single-symbol reel for displaying a single symbol in a single symbol position and at least one multi-symbol reel for displaying a plurality of symbols in a respective plurality of symbol positions, and using at least one processor to form at least one payline extending through the single symbol displayed on the at least one single-symbol reel and at least one of the plurality of symbols displayed on the at least one multi-symbol reel.

9. The method of claim 8, wherein the act of using the at least one processor to form at least one payline includes forming multiple paylines.

10. The method of claim 9, wherein the at least one single-symbol reel is a plurality of single-symbol reels forming multiple rows, at least one of the multiple paylines extending through a first one of the multiple rows and at least one of the plurality of symbols displayed on at least one multi-symbol reel, at least another of the multiple paylines extending through a second one of the multiple rows and at least one of the plurality of symbols displayed on at least one multi-symbol reel.

11. The method of claim 9, further comprising:

using the at least one processor to activate one or more of the multiple paylines; and providing an award if the one or more activated paylines includes a winning symbol combination, at least one symbol forming the winning symbol combination being displayed on the at least one single-symbol reel, and at least another symbol forming the winning symbol combination being displayed on the at least one multi-symbol reel.

12. The method of claim 8, wherein the at least one single-symbol reels is four, forming two rows and two columns.

13. The method of claim 8, wherein the at least one single-symbol reel is a plurality of single-symbol reels forming a first group of rows and the at least one multi-symbol reel is a plurality of multi-symbol reels forming a second group of rows, the number of the first group of rows being different from the number of the second group of rows.

14. The method of claim 8, wherein each of the at least one single-symbol reel includes a second plurality of symbols, the single symbol displayed on the at least one single-symbol reel being one of the second plurality of symbols.

15. The method of claim 13, wherein the plurality of symbols on the at least one multi-symbol reel is displayed in response to a predetermined condition being met on the at least one single-symbol reel.

16. One or more machine-readable storage media including instructions which, when executed by one or more processors, cause the one or more processors to perform operations comprising:

receive a wager in response to an input via at least one input device, display a plurality of reels on at least one display device, the plurality of reels including at least one single-symbol reel for displaying a single symbol in a single symbol position and at least one multi-symbol reel for displaying a plurality of symbols in a respective plurality of symbol positions, and use the one or more processors to form a payline extending through the single symbol displayed on the at least one single-symbol reel and at least one of the plurality of symbols displayed on the at least one multi-symbol reel.

17. The machine-readable storage media of claim 16, wherein the plurality of reels includes a plurality of single-symbol reels.

18. The machine-readable storage media of claim 17, wherein the plurality of single-symbol reels form multiple columns, the randomly selected outcome being indicated by the symbols aligned along an active payline extending through at least two single symbols displayed on the respective single-symbol reels and at least one of the plurality of symbols displayed on at least one of the multi-symbol reels.

19. The machine-readable storage media of claim 17, wherein the plurality of single-symbol reels form a first group of rows, at least one payline extending through a first one of the first group of rows and at least one of the plurality of symbols displayed on at least one of the multi-symbol reels, at least another payline extending through a second one of the first group of rows and at least one of the plurality of symbols displayed on at least one of the multi-symbol reels, the randomly selected outcome being indicated by symbols aligned along the paylines.

20. The machine-readable storage media of claim 16, wherein each of the at least one single-symbol reel includes a second plurality of symbols, the single symbol displayed on the at least one single-symbol reel being one of the second plurality of symbols.

* * * * *